US005469916A

United States Patent [19]

Sas-Jaworsky et al.

[11] Patent Number: 5,469,916

[45] Date of Patent: Nov. 28, 1995

[54] SYSTEM FOR DEPTH MEASUREMENT IN A WELLBORE USING COMPOSITE COILED TUBING

[75] Inventors: Alex Sas-Jaworsky, Houston; Jerry G. Williams, Ponca City, both of Tex.

[73] Assignee: Conoco Inc., Ponca City, Okla.

[21] Appl. No.: 214,720

[22] Filed: Mar. 17, 1994

[51] Int. Cl.[6] ..... E21B 47/04; E21B 47/09

[52] U.S. Cl. ..... 166/64; 138/104; 166/66; 166/66.5

[58] Field of Search ..... 166/64, 66, 66.5, 166/77; 138/104

[56] References Cited

U.S. PATENT DOCUMENTS

| | | | |
|---|---|---|---|
| 3,513,912 | 5/1970 | Boop | 166/66.5 |
| 4,265,304 | 5/1981 | Baugh | 166/77 |
| 4,690,218 | 9/1987 | Sumner | 166/64 |
| 5,018,583 | 5/1991 | Williams | 166/385 |
| 5,080,175 | 1/1992 | Williams | 166/385 |
| 5,097,870 | 3/1992 | Williams | 138/115 |
| 5,172,765 | 12/1992 | Sas-Jaworsky et al. | 166/384 |
| 5,176,180 | 1/1993 | Williams et al. | 138/172 |
| 5,234,053 | 8/1993 | Connell | 166/77 X |
| 5,234,058 | 8/1993 | Sas-Jaworsky et al. | 166/385 |
| 5,243,128 | 9/1993 | Marcoz | 138/104 X |
| 5,279,366 | 1/1994 | Scholes | 166/66.5 X |
| 5,285,204 | 2/1994 | Sas-Jaworsky et al. | 138/172 |

*Primary Examiner*—Hoang C. Dang

*Attorney, Agent, or Firm*—M. Kathryn Tsirigotis; John E. Holder

[57] ABSTRACT

This invention is directed to a system for determining the position and depth of downhole equipment in a wellbore which includes an elongate spoolable composite coiled tubing for running the downhole equipment into the wellbore. The composite coiled tubing string has multiple layers of fibers arranged in a generally cylindrical shape, wherein each layer has a plurality of fibers arranged in a predetermined orientation to form a composite coiled tubing string having sufficient strength to be pushed into and pulled and out of the borehole. A plurality of detectable indicia (such as metallic, magnetic or encoded sections) overlay at least one of the layers of fibers and are integral to the composite coiled tubing string and spaced apart along the length of the tubing string at predetermined distances. As the tubing is raised and lowered in the wellbore, a detecting means detects the presence of the indicia in the composite coiled tubing string for determining the location of a particular point on the string relative to a particular position in the wellbore and can also be used for determining the composite coiled tubing behavior in relation to load and load deformation.

17 Claims, 3 Drawing Sheets

SYSTEM FOR DEPTH MEASUREMENT IN A WELLBORE USING COMPOSITE COILED TUBING

FIELD OF THE INVENTION

This invention relates to a system for determining the position of downhole tools and equipment or pipe in wellbores and more particular to systems for determining the position or location of composite coiled tubing being used for well operations such as performing workovers, testing, maintenance and the like.

BACKGROUND OF THE INVENTION

Coiled steel tubing finds a number of uses in oil well operations. For example, it is used with wireline cable for running well tools, such as logging tools and perforating tools downhole. Such tubing is also used in the workover of wells, to deliver various chemicals and perform other functions or in any number of operations where coiled tubing may be remotely positioned such as in downhole production tubing, pipelines or flowlines.

In all operations, the various depth or distance measurements of a tool or some location on the coiled tubing in a remote location is important. Typically, the length of coiled tubing is measured by a wheel and mechanical counter as it is spooled off or onto the reel. The accuracy of such measuring devices is questionable particularly if long lengths of coiled tubing are deployed and retrieved from the well. The depths at which coiled tubing is used is expected to get substantially greater with the development of better materials and techniques. Thus, coiled tubing technology will need a commensurate development in depth measuring technology. Outside of the coiled tubing technology, techniques have been developed for electronically measuring the depth of drill pipe and casing.

Composite coiled tubing will likely be subject to much greater length variation as it is used, than is the case with steel tubing. Thus, for oil field applications, where precise positioning of tools, equipment, or the like on the tubing will be involved, the elongation of the composite coiled tubing string in use presents a location measurement problem more complex than normally encountered with steel coiled tubing.

Accordingly it is an object of the present invention to provide a new and improved system for position and depth measurement of downhole equipment in a wellbore using composite coiled tubing having integral and detectable indicia which are arranged along the length of the coiled tubing in a manner to permit the determination of the depth or position of the composite coiled tubing in the borehole.

SUMMARY OF THE INVENTION

A system for determining the position and depth of downhole equipment in a wellbore including an elongate spoolable composite coiled tubing for running downhole equipment into a wellbore and a surface means for spooling and unspooling the tubing string and equipment into and out of the wellbore. The composite coiled tubing string has multiple layers of fibers arranged in a generally cylindrical shape, wherein each layer has a plurality of fibers arranged in a predetermined orientation to form a composite coiled tubing string having sufficient strength to be pushed into and pulled out of the borehole. A plurality of detectable indicia (such as metallic, magnetic or encoded portions) overlay at least one of the layers of fibers and are integral to the composite coiled tubing string and spaced apart along the length of the tubing string at predetermined distances. A resin matrix fixes the fibers in their predetermined orientations and fuses the layers and the indicia together.

As the tubing is raised and lowered in the wellbore, a detecting means ascertains the presence of the indicia in the composite coiled tubing string for determining the location of a particular point on the string relative to a particular position in the wellbore as the tubing is raised and lowered in the wellbore.

BRIEF DESCRIPTION OF THE DRAWINGS

Some of the objects have been stated and others will become apparent as the description proceeds when taken in conjunction with the accompanying drawings in which.

DESCRIPTION OF THE PREFERRED EMBODIMENT

Figure 1:
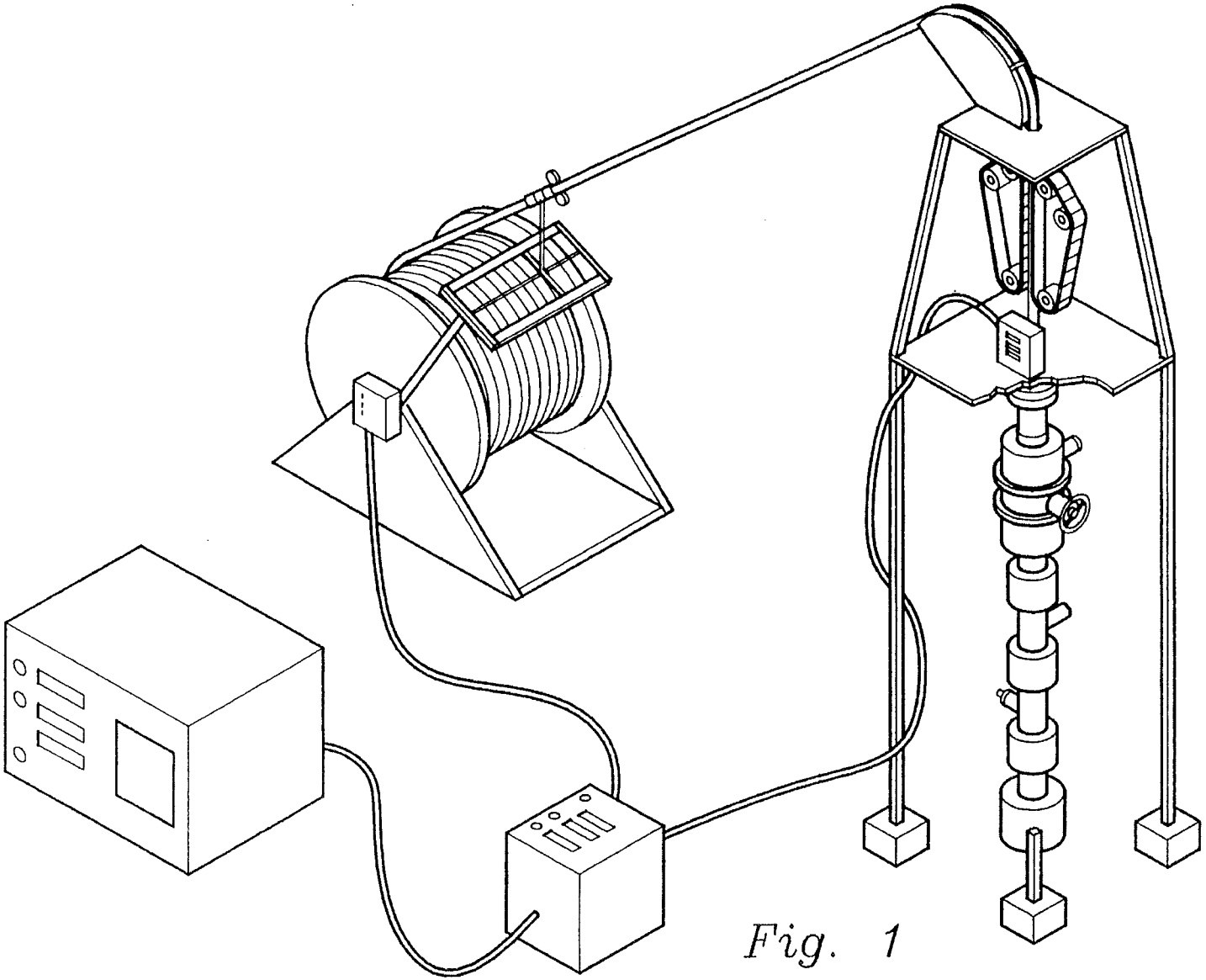
FIG. 1 is a perspective view of a coiled tubing installation arrangement for installing the composite coiled tubing of the present invention.

Referring now to the drawings, FIG. 1 schematically shows a coiled tubing installation arrangement generally indicated by the number 10. The coiled tubing 12 is stored on a reel or service spool 15 and unwound by a suitable mechanism 16 and conducted to a tractor feed installation 20 for running the coiled tubing 12 through the wellbore fittings 28 and into and out of the wellbore. The tractor feed installation 20 generally comprises two substantially opposed hydraulically powered endless tracks 21 and 22 mounted on a riser or structure 24 above the wellbore fittings 28. The tracks 21 and 22 pinch the tubing 12 therebetween for pushing it down into the wellbore or lifting it back out. Operation of the system 10 is conducted at an operator station 25 and the power for the service spool 15 and tractor feed installation 20 is provided by suitable hydraulic pump or electric generator 26.

In this invention the coiled tubing 12 is comprised of composite material with detectable indicia 13 spaced longitudinally along the length thereof. The detectable indicia 13 may be spaced randomly along the length of the tubing string 12 or arranged at a predetermined spacing. As illustrated in FIG. 1 the means for detecting indicia 30 in the composite coiled tubing 12 as the tubing 12 is raised and lowered in the wellbore can be mounted adjacent the tubing 12 on the structure 24. However, the detecting means can also be located downhole in the wellbore (not shown).

Figure 2:
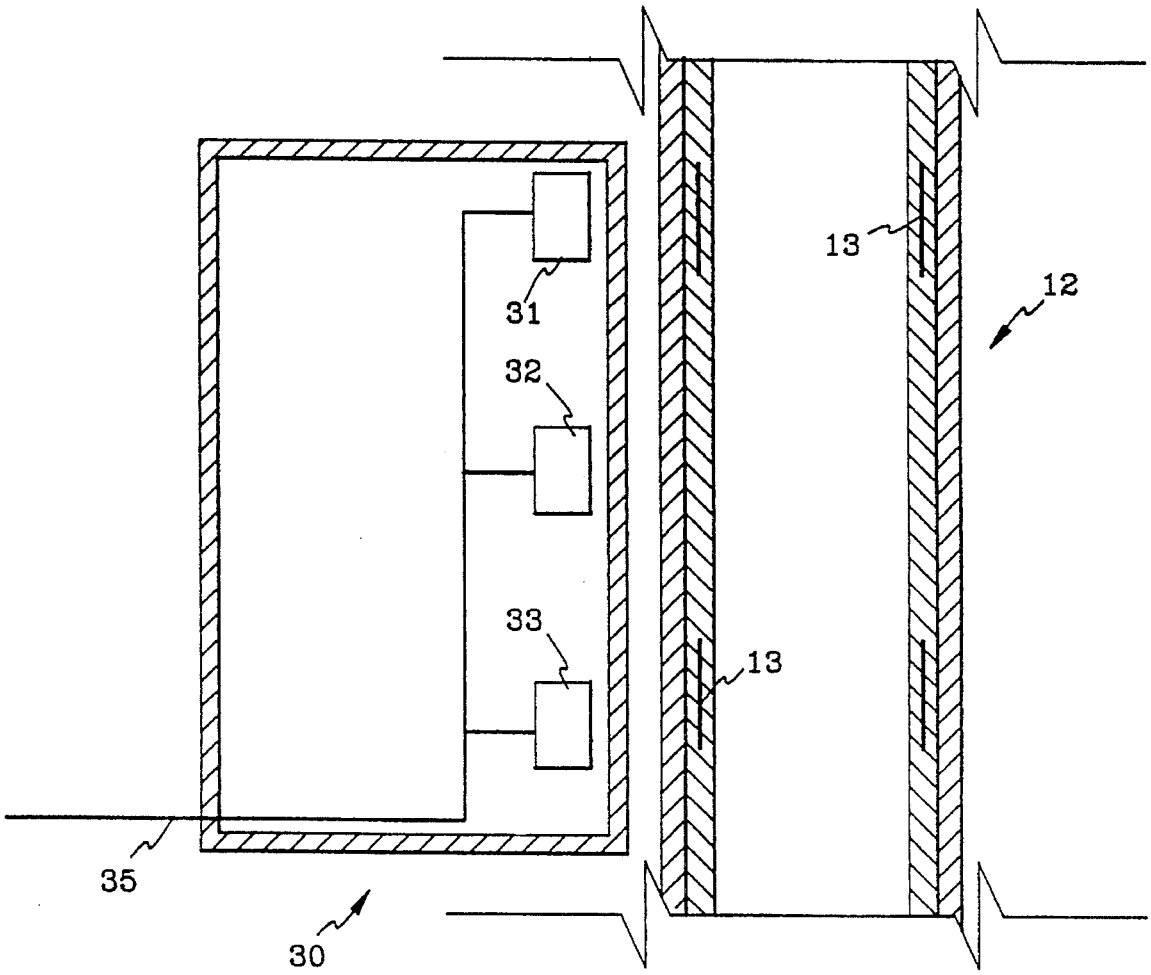
FIG. 2 is an enlarged cross sectional view of the composite coiled tubing passing an electronic detection device taken along the line 2—2 in FIG. 1.

One embodiment of the detecting means, as shown in FIG. 2, is an electronic depth measuring device 30 which includes one or more sensors such as the three sensors indicated by the numbers 31, 32, and 33 for measuring the depth of the composite coiled tubing 12 in the wellbore. The sensors 31, 32, and 33 sense the detectable indicia 13 in the composite coiled tubing 12. The detectable indicia 13 may be comprised of a variety of materials such as metallic or magnetic sections, radioactive materials, optical devices, specifically encoded sections or a combination of any of these materials. In the embodiment shown in FIG. 2, the indicia are shown as metallic sections 13. The composite coiled tubing 12 is non-metallic and non-magnetic therefore, the electronic depth measuring device 30 senses a magnetic field when the metallic sections 13 pass the device 30. The device 30 keeps count of the number of metallic sections 13 that have passed the device 30 going into the borehole thereby measuring the depth of the composite coiled tubing 12 in the wellbore. The device can also send signals to a remote location where the signals are then analyzed and counted. There are known systems which sense an increase in the mass of metal strings such as drill pipe and casing indicating a connection between sections of the drill pipe or casing. Accordingly, the aspect of recording and counting the number of metallic sections 13 is sufficiently understood by those skilled in the art that further explanation is unnecessary.

The means for detecting the indicia can include various types of sensors, such as an electronic device that senses resistance, current flow or capacitance of metallic sections as they pass the sensor. The detecting means can also include sensors which detects light from indicia which are optical devices such as fiber optics or diodes. Such light detecting means could be used at the surface or downhole. If radioactive indicia are used, a sensor which detects the presence and amount of radiation passing it, such as a Geiger counter, is included in the detecting means. A laser sensor in the detecting means can also be used to detect specifically encoded sections such as bar coding.

The means for detecting the indicia may determine diverse information regarding the composite coiled tubing. For example, the detecting means may determine the location of a particular point on the string relative to a particular position in the wellbore as the tubing is raised and lowered in the wellbore giving general depth measurement information of the tubing and the downhole equipment. The behavior of the composite coiled tubing may also be determined in relation to load. For example, damage to the tubing due to load deformation or permanent lengthening of the tubing in proportion to the load. The indicia may also comprise specifically encoded sections related to a position on the coiled tubing string and the detection means would then measure relative depths at different parts or sections of the tubing. This would also give an indication of the tensile load on the tubing string by measurement of the stretch of the composite coiled tubing which is predictable in tension. Thus a strain gauge output might also be detected instead of distance between or number of indicia.

In the present invention, the coiled tubing 12 is made of advanced composite materials for better strength, stiffness and bending characteristics as well as longer useful life. However, there are many design factors that must be considered for composite coiled tubing and particularly for tubing that will include the detectable indicia as discussed above. Composite fibers (graphite, aramid, fiberglass, boron, etc.) have numerous attributes including high strength, high stiffness, light weight, etc., however, the stress strain response of composite fibers is linear to failure. Thus, the fibers are non ductile and the composite coil tubing design must meet the strength stiffness and bending requirements with a near elastic response. Such a composite design must be tailored to exhibit high resistance to bending stresses and internal pressure as well as torsion. It must also have high axial stiffness, high tensile strength and be resistant to shear stress. All of these properties are combined in the composite tubular member of the invention to provide a coiled tube which can be bent to a radius compatible with a reasonable size spool. Moreover, the design must accommodate the detectable indicia 13 without permitting the indicia 13 to initiate manufacturing flaws or fracture and delamination points after a number of successive uses.

Figure 3:
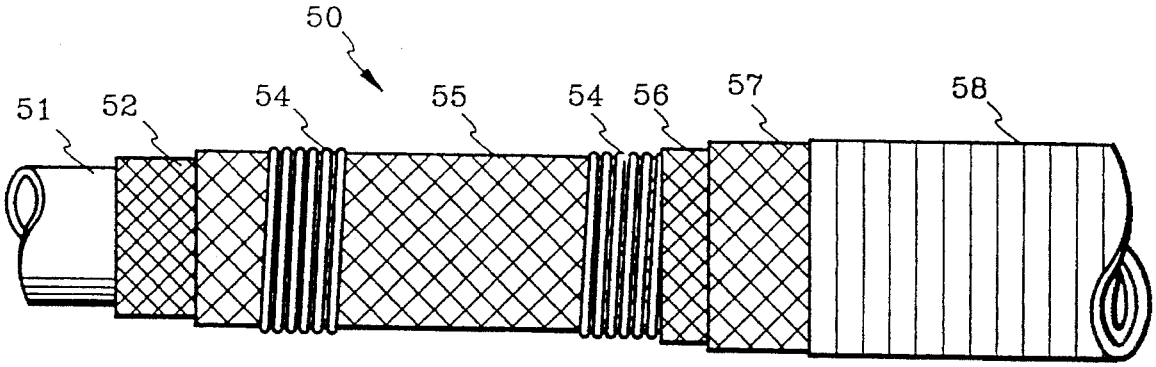
FIG. 3 is an enlarged fragmentary view of a first embodiment of the composite coiled tubing showing the construction thereof.

FIG. 3 illustrates an embodiment of the composite coiled tubing generally indicated by the number 50. The tubing preferably includes a plastic tubular liner although certain embodiments may use the wall structure itself as a liner. The liner may be made of variety of materials such as polyethylene, nylon or fluoropolymers. Overlying the liner 51 is a first layer of fibers 52 wrapped onto the liner 51 in a predetermined orientation relative to the longitudinal is of the tubing 50. As illustrated the first layer of fibers are arranged in a cross plied or criss cross pattern. There are an infinite variety of angles that the fibers can be oriented. A second layer of fibers 55 is provided over the first layer 52 so as to form a multilayered composite coil tubing. Typically, the fibers of the second layer 55 have a different predetermined orientation than the fibers of the first layer 52.

In the drawings, only four layers are shown for illustration purposes, however, the composite coil tubing may have more layers as is necessary for design purposes. For example, a particular composite coil tubing design may include fifteen fiber layers. While the application of the fiber layers has been described as wrapping, the fibers can be interlaced as they are overlaid onto the sublayer thus forming a fabric or braided or filament wound fiber layer. The sublayer may simply comprise interlaced cross plied fibers oriented at an angle to the longitudinal axis of the tubing. U.S. Pat. Nos. 5,018,583, 5,080,175, 5,172,765, 5,097,870, 5,176,180, and 5,234,058, which are incorporated herein by reference, illustrate composite coiled tubing arrangements that can be used in conjunction with the present invention.

As illustrated, in the embodiment shown in FIG. 3, the detectable indicia is a metal wire 54 which is wrapped over the second layer of fibers 55 at predetermined distances along the tubing. It is preferred that the coils of the metal wire 54 are spaced apart for reasons that will be explained below. Any suitable wire such as copper, steel, aluminum etc. may be used so long as it is detectable by the device 30 and will flex with the tubing without damage to the indicia or the tubing. A third layer of oriented fibers 56 similar to the first and second layer of fibers is wrapped over the wires 54 and the second layer of fibers 55. A fourth layer of oriented fibers 57 similar to the prior layer of fibers is wrapped over the third layer of fibers. The fibers in the layers 52, 55, 56, and 57 are provided with a resin distributed throughout the layers. The resin is preferably a thermoplastic or thermosetting resin such as vinyl ester, epoxy, or poly-ether-ether-ketone (PEEK). Preferably the fibers are surrounded with the resin so as to provide a uniform distribution throughout all the fiber layers. When the outer fiber layer 57 has been wrapped onto the tubing, the resin is cured or consolidated to form a matrix fixing the fibers in their respective orientations.

As noted above, the wire 54 was applied with some space between the coils. This allows some of the resin to fill between the coils and hold the second layer to the third layer. Once the resin is cured, it is preferred to provide a wrapping 58 of protective material over the fourth and outer layer of fibers 57.

A layer of protective material 58 may be provided over the final fiber resin layer to protect the coiled tubing 50 and make it smooth for insertion into the borehole. The outer layer 58 is preferably comprised of an abrasion and chemically resistant material such as nylon, polyurethane or a fluoropolymer. The outer layer may also be reinforced with fibers such as aramid, carbon or glass. Sometimes the outer fiber layer, depending on the fiber and the resin, may not be as smooth and friction free as desired, so a wrapping of such selected materials is preferred. However, with some types of indicia, such as optical devices or encoded sections, it is preferred not to have an outer layer of wrapping over the indicia.

Figure 4:
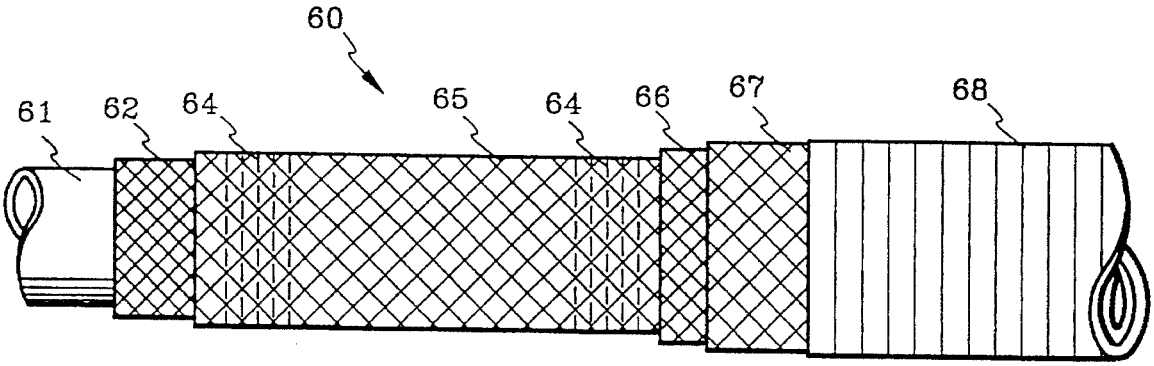
FIG. 4 is an enlarged fragmentary view similar to FIG. 3 of a second embodiment of the composite coiled tubing.
Figure 5:
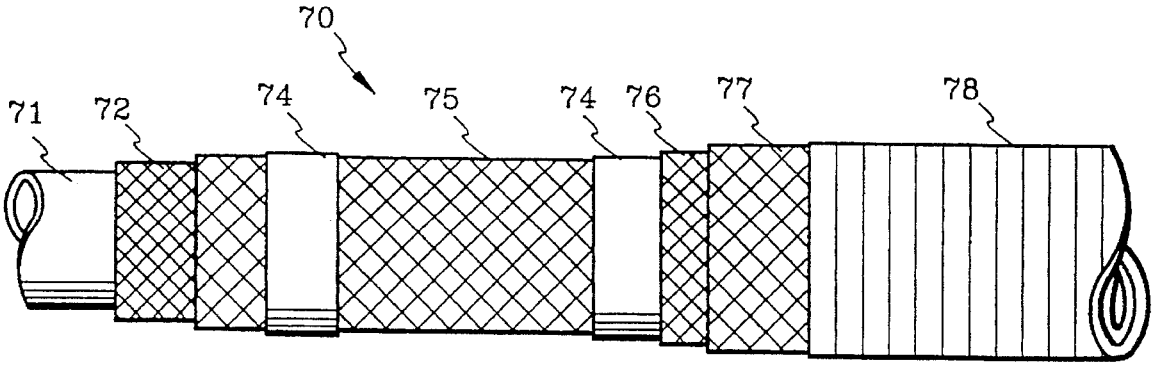
FIG. 5 is an enlarged fragmentary view similar to FIG. 3 of a third embodiment of the composite coiled tubing.

In a second embodiment, illustrated in FIG. 4, the metal wire 64 is interlaced with the fibers of the second layer 65 so that as the fibers are wrapped and interlaced onto the outside of the liner 61 or previous layer of fibers 62, the metal wire 64 is interlaced along therein to form the metal portion 64 for detection by the sensor of the depth measuring device 30. Except for the interlacing of the metal wire 64 with the fiber layer 65, the second embodiment is similar to the first.

In a third embodiment, the metal portion comprises a thin, narrow metal band 74 wrapped around the predetermined fiber layer at the predetermined longitudinal spacing. The band 74 must be selected for its thin radial dimension as well as a relatively short longitudinal dimension so as to limit the possibilities of the composite tubing delaminating. For this reason the prior embodiments with wire as the metal portions are preferred since they do not create as large of void in the interior of the layers of fiber. The metal band 74 may, however, be overwrapped along the outside of the outer fiber layer 77 and then covered by the protective wrapping 78. As such, the metal band 74 is outside the matrix so it is less likely to cause delamination of the coiled tubing 70.

In the drawings, only a cylindrical shape is shown for illustration purposes, however, the composite coiled tubing may have variations in its generally cylindrical shape such as shown in U.S. Pat. No. 5,097,870 to enhance stiffness or provide for multiple cells within the composite coiled tubing for different design purposes. Therefore, while the term generally cylindrical shape is used to describe and claim the coiled tubing string of this invention, it is intended that the term should cover all such composite coiled tubing strings.

While certain embodiments and details have been shown for the purpose of illustrating the present invention, it will be apparent to those skilled in the art that various changes and modifications may be made herein without departing from the spirit or scope of the invention.

What is claimed is:

1. A system for determining the position and depth of downhole equipment in a wellbore including an elongate spoolable composite coiled tubing for running said downhole equipment into said wellbore comprising:

a composite coiled tubing string having multiple adjacent layers of fibers arranged in a generally cylindrical shape, wherein each layer has a plurality of fibers arranged in at least one predetermined orientation to form a composite coiled tubing string having sufficient strength to be pushed into and pulled and out of the borehole;

a plurality of detectable indicia overlaying at least one of said layers of fibers and integral to said composite coiled tubing string and spaced apart along the length of said composite coiled tubing string;

a resin uniformly distributed throughout all the fiber layers and consolidated to form a matrix for fixing all the multiple layers of fibers and the detectable indicia together in their predetermined orientation;

means for detecting the presence of said indicia in said composite coiled tubing string as the tubing is raised and lowered in the wellbore;

means for determining said composite coiled tubing behavior in relation to load; and means for spooling and unspooling said composite coiled tubing string and said downhole equipment from the surface into and out of the wellbore.

2. The system of claim 1 wherein the resin matrix is fused about the fibers and fiber layers and said detectable indicia so that voids are not present in said matrix.

3. The system of claim 1 wherein said means for detecting the presence of said indicia is located at the surface adjacent the wellbore.

4. The system of claim 1 wherein said means for detecting the presence of said indicia is located downhole in said wellbore.

5. The system of claim 1 wherein said indicia is spaced apart along the length of said composite coiled tubing string at predetermined distances.

6. The system of claim 1 wherein said indicia is positioned in said matrix so that at least one protective fiber layer is overlaying said indicia.

7. The system of claim 1 wherein said indicia is comprised of metallic sections.

8. The system of claim 7 wherein said metallic sections comprise metal wire wound about said at least one layer of fibers.

9. The system of claim 7 wherein said fibers are interlaced as they are formed into a generally cylindrical shape to form braided fiber layers and wherein said metallic sections comprise metal wire interlaced with said at least one layer of fibers.

10. The system of claim 7 wherein said metallic sections comprise thin metallic bands overlaid on said at least one layer of fibers.

11. The system of claim 7 wherein said metallic sections are comprised of a magnetic material.

12. The system of claim 1 wherein said indicia is comprised of coded data related to a position on the coiled tubing string.

13. The system of claim 1 wherein said indicia is comprised of radioactive materials.

14. The system of claim 1 wherein said indicia is comprised of optical devices.

15. The system of claim 3 or 4 wherein the means for detecting said indicia includes a means for determining the location of a particular point on the string relative to a particular position in the wellbore as said tubing is raised and lowered in the wellbore.

16. An elongate spoolable composite coiled tubing for running downhole equipment in a wellbore, wherein said tubing has peripheral walls and means within said peripheral walls cooperating with a depth measuring device to measure the depth of the spoolable longitudinal composite coiled tubing within the wellbore and thus the depth of the downhole equipment in the borehole and for determining changes in the tubing due to load deformation, said composite coiled tubing comprising;

a plurality of overlying adjacent layers of fibers arranged in a generally cylindrical shape to form the peripheral walls of said composite coiled tubing, wherein each layer has a plurality of fibers arranged in at least one predetermined orientation so that said composite coiled tubing is provided with sufficient strength to be pushed into and pulled out of a wellbore;

a plurality of detectable portions overlying at least one of said layers of fibers and spaced apart along the length thereof at a common predetermined distance for the depth detecting device to detect and count as the composite coiled tubing is raised and lowered in the borehole;

at least one protective fiber layer overlying said first recited at least one of said layers of fiber and said detectable portions; and a resin uniformly distributed throughout all the fiber layers and consolidated to form a matrix for fixing the fibers in the layers in their predetermined orientations and fusing the layers of fibers and detectable portions together so that the at least one of said layers on which the detectable portions are overlying and the protective fiber layer overlying said first recited at least one of said layers of fiber and said detectable portions are all bonded together in a unified matrix which fixes the fibers and detectable portions in their respective orientations and prevents fracture and delamination points.

17. The apparatus of claim 16 wherein said layers of fiber are arranged in a generally cylindrical shape about a liner to form the walls of said coiled tubing and wherein said detectable portions include indicia means fixedly embedded in the layers to provide an indication when detected of the location of particular positions on the coiled tubing; and a thermoplastic or thermosetting resin uniformly distributed throughout all the fiber layers and consolidated to form a matrix for fixing all the fiber layers and the indicia means together in their predetermined orientation.

* * * * *

UNITED STATES PATENT AND TRADEMARK OFFICE

CERTIFICATE OF CORRECTION

PATENT NO. : 5,469,916

DATED : November 28, 1995

INVENTOR(S) : Alex Sas-Jaworsky, et al.

It is certified that error appears in the above-indentified patent and that said Letters Patent is hereby corrected as shown below:

Column 3, line 43, before "in proportion" add --will be indicated by an unpredicted change in spacing between indicia--.

Column 4, line 10, after "liner" add --51--.

Column 4, line 12, after "liner" add --51--.

Column 4, line 15, "is" should be --axis--.

Signed and Sealed this

Twenty-seventh Day of February, 1996

Bruce Lehman

*Attest:*

BRUCE LEHMAN

*Attesting Officer*

*Commissioner of Patents and Trademarks*